United States Patent [19]

Loberg

[11] Patent Number: 5,012,976

[45] Date of Patent: May 7, 1991

[54] FLUID DRIVEN TANK CLEANING APPARATUS

[75] Inventor: Loren L. Loberg, Lafayette, Calif.

[73] Assignee: Sybron Chemicals, Inc., Hayward, Calif.

[21] Appl. No.: 443,722

[22] Filed: Nov. 29, 1989

[51] Int. Cl.[5] ..... B05B 3/00

[52] U.S. Cl. ..... 239/227; 239/240; 239/246

[58] Field of Search ..... 239/225.1, 227, 240, 239/243, 246, 248, DIG. 1, DIG. 13

[56] References Cited

U.S. PATENT DOCUMENTS

| | | | |
|---|---|---|---|
| 2,029,788 | 2/1936 | Ostling | 239/227 |
| 2,108,787 | 2/1938 | Coles et al. | 239/246 |
| 2,681,250 | 6/1954 | Metcalf et al. | 239/227 |
| 3,255,969 | 6/1966 | Saad . | |
| 3,275,241 | 9/1966 | Saad . | |
| 3,326,468 | 6/1967 | Bristow et al. | 239/240 |
| 3,464,632 | 9/1969 | Bristow | 239/227 |
| 3,637,138 | 1/1972 | Rucker | 239/227 |
| 3,747,854 | 7/1973 | Anderson | 239/227 |
| 4,664,720 | 5/1987 | Rucker | 239/227 |

FOREIGN PATENT DOCUMENTS

| | | | |
|---|---|---|---|
| 655892 | 1/1963 | Canada | 239/227 |

OTHER PUBLICATIONS

Water Flow Through Rojet 80-Rochem Equipment Ltd.

*Primary Examiner*—Andres Kashnikow
*Assistant Examiner*—Michael J. Forman
*Attorney, Agent, or Firm*—Marjama & Pincelli

[57] ABSTRACT

A fluid device tank cleaning apparatus having a stationary housing, an outer Tee-housing which rotates about a first axis and nozzle assembly rotatably mounted to the Tee-housing for rotation about a second axis. The stationary housing is provided with passageways for communication with the Tee-housing. The passageways are configured so as to provide a substantially constant cross sectional area to the outer of the Tee-housing.

5 Claims, 3 Drawing Sheets

FLUID DRIVEN TANK CLEANING APPARATUS

The present invention relates to an apparatus for cleaning the interior surface of chambers; for example, reaction chambers, polymerization tanks, assorted liquid storage tanks, large diameter pipe, and similar type containers.

BACKGROUND OF THE INVENTION

The chemical, food and beverage processing industries use a variety of process, transportation and storage vessels which must be periodically cleaned. Typically, such vessels or tanks are cleaned by a spraying apparatus which uses the cleaning fluid to be sprayed within the tank to drive the spray assembly in a predetermined pattern. Typically such devices are designed to rotate about two perpendicular axis at the same time. That is, the spray nozzle rotates about a first axis and the portion of the device that the spray nozzle is mounted is simultaneously rotated about a second axis which is generally perpendicular to the first axis. This provides a spray cleaning pattern which covers the interior of the vessel in a quick and efficient manner. An example of such a prior art device is illustrated by U S. Pat. No. 3,637,137. More particularly, these devices typically comprise a stationary inlet housing having a first generally vertical axis, a Tee-housing that is rotatably mounted to the inlet housing so as to rotate about a first vertical axis and a spray nozzle assembly secured to the Tee-housing which is designed to rotate about a second axis which is substantially perpendicular to the vertical axis. Positive gearing means are used to drive the Tee-housing and nozzle assembly in a predetermined pattern. In order to provide an appropriate fluid passageway between the stationary inlet housing and Tee-housing, a plurality of spaced discharge openings are placed about the circumference of the inlet stem. The Tee-housing comprises a generally cylindrical body which forms a receiving chamber with the inlet stem for receiving fluid from the discharge opening of the inlet stem, and a nose section for directing fluid into the nozzle assembly. The nose section is positioned adjacent the discharge openings. A problem encountered with such device is that as the Tee-housing rotates about the inlet stem, the discharge openings in the inlet stem communicate in a periodic fashion with the nose section of the Tee-housing. This results in pulsating fluid pressure in the Tee-housing. This affects the fluid flow within the device and ultimately its cleaning efficiency. An additional problem with such prior art devices is the difficulty in providing a smooth and uninterrupted flow pattern due to the three part assembly necessary for the dual rotational movement.

Applicant has invented an improved tank cleaning apparatus which minimizes or eliminates the pulsating pressure effect and also provides improved fluid flow pattern within the device while still providing a controlled predetermined spray pattern.

SUMMARY OF THE INVENTION

A fluid driven tank cleaning apparatus comprising: a housing having an inlet stem and gear train housing secured thereto. The inlet stem includes a fluid receiving chamber, an inlet for connecting the fluid receiving chamber to a source of fluid under pressure and a plurality of discharge openings at its rearward end. The gear train housing has a secondary chamber separate from the fluid receiving chamber. A drive shaft is rotatably mounted within the receiving chamber. Drive means is provided in the inlet and is connected to the drive shaft for rotating the drive shaft in response to fluid entering the inlet stem. Gear reduction means is provided which is connected to the drive shaft for reducing the rotational speed of the drive shaft. A Tee-housing is rotatably mounted to the inlet stem and gear train housing so as to rotate about a first axis and has an inlet/outlet for allowing discharge of the fluid. An output shaft is rotatably mounted in the secondary chamber and is connected to the drive shaft through the gear reduction means. A fluid nozzle assembly is mounted to the Tee-housing for rotation about a second axis, and is fluidly connected to the fluid receiving chamber through a plurality of discharge openings in the inlet stem. Means for connecting the output shaft to the nozzle assembly is provided so as to cause the nozzle assembly to rotate about the secondary axis in a predetermined manner. The discharge openings in the inlet stem having a size and configuration such that a substantially constant cross-sectional area of discharge opening is exposed to the inlet/outlet of the Tee-housing as the Tee-housing is rotated about the inlet stem.

DETAILED DESCRIPTION OF THE INVENTION

Figure 1:
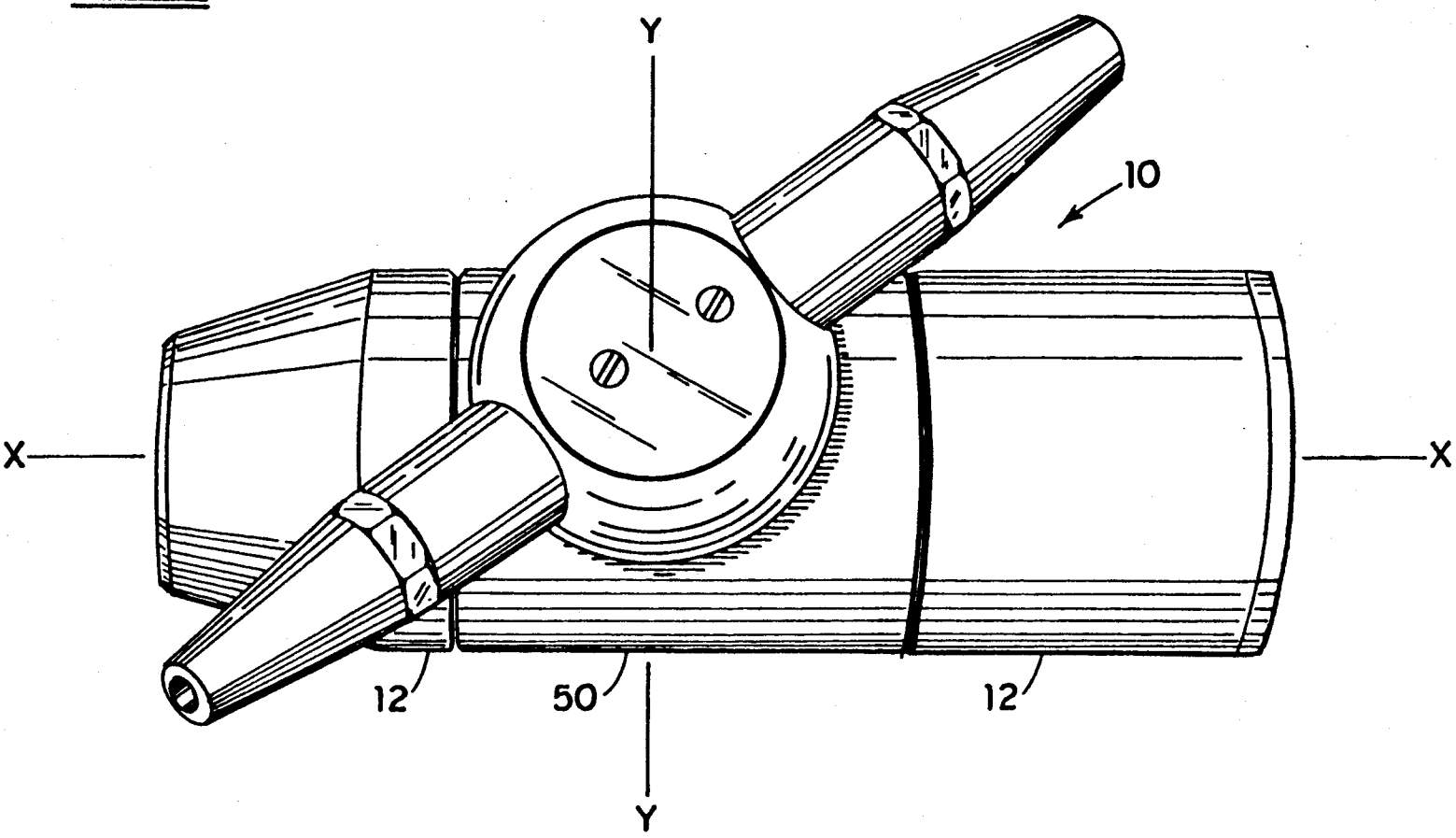
FIG. 1 illustrates a perspective view of an apparatus made in accordance with the present invention.
Figure 2:
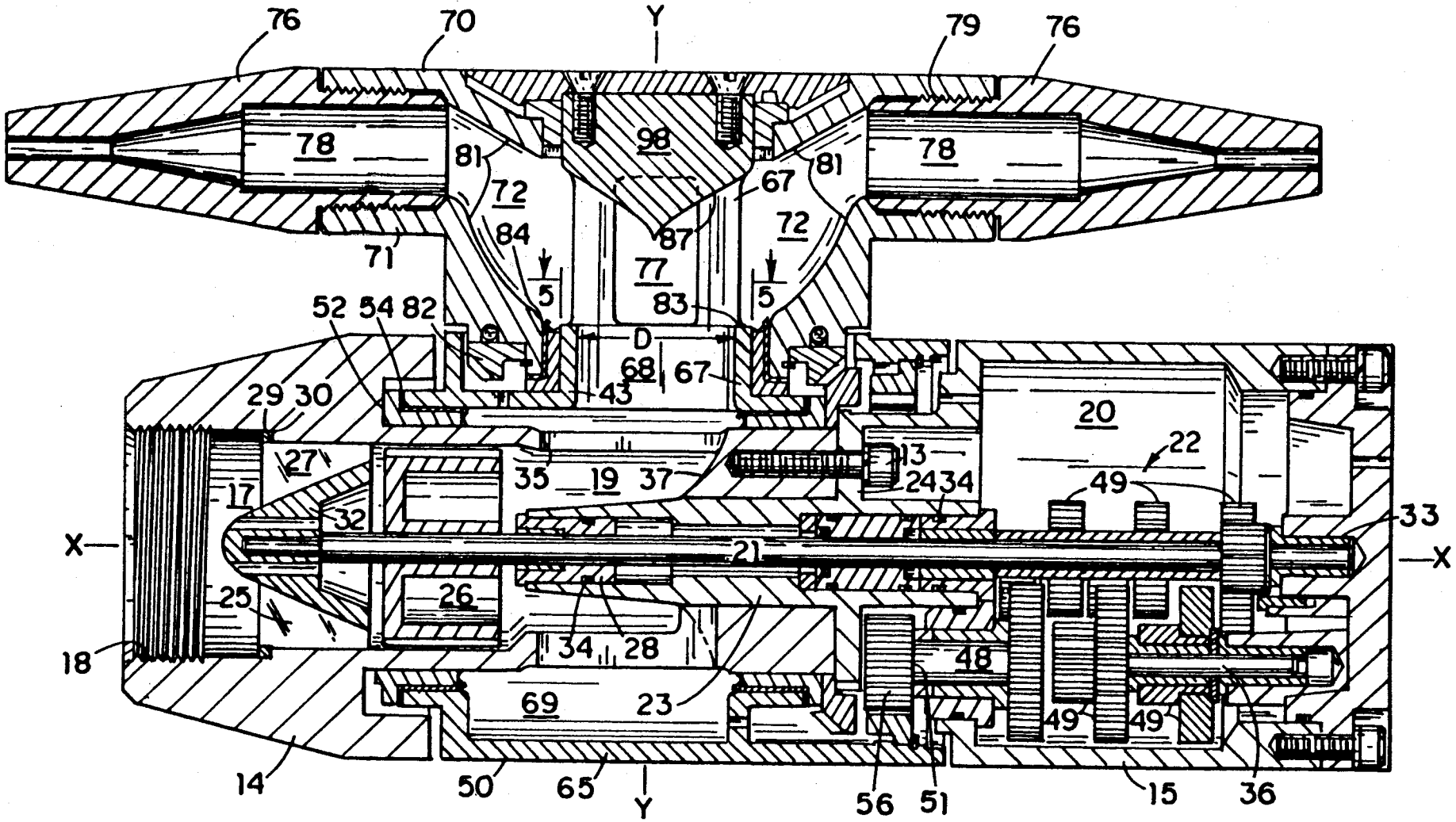
FIG. 2 is a cross-sectional view taken along axis X—X of FIG. 1.

Referring to FIGS. 1–4 there is illustrated a fluid tank cleaning apparatus 10 made in accordance with the present invention. The apparatus 10 includes a housing 12 which comprises inlet stem 14 having a gear train housing 15 secured thereto. In the particular embodiment illustrated, the gear train housing 15 is secured to inlet stem 14 by a plurality of circumferentially spaced screw 13 (only one of which is illustrated in FIG. 2) each passing through an opening in gear train housing 15 into the rearward end of inlet stem 14. However, it is to be understood that the inlet stem 14 may be secured to gear train housing 15 in any desired manner. The inlet stem 14 has an inlet 17 for connection to a source of cleaning fluid under pressure. Typically, the cleaning fluid is pressurized from about 40 psi to 250 psi. In the particular embodiment illustrated, the inlet stem 14 is provided with internal threads 18 which are capable of being connected to an appropriate coupling (not shown) having a corresponding male threaded section. It is of course understood that the inlet stem 14 may be connected in any desired manner to the source of cleaning fluid. The inlet stem 14 includes a receiving chamber 19 which is in fluid communication with inlet 17. The housing 12 is further provided with a secondary chamber 20 in gear train housing 15 which is separated from receiving chamber 19 by a common wall 24. A gear train 22 is provided in secondary chamber 20 which is used to drive certain other parts of tank cleaning apparatus 10 as will be later described herein.

Rotatably mounted within receiving chamber 19 is a primary drive shaft 21. In the particular embodiment illustrated the forward end 27 of drive shaft 21 is rotatably mounted within bearing 28 in projecting boss 23 which extends from common wall 24. Appropriate seals 34 are provided as required. Mounted at the forward end of receiving chamber 19 is drive means for rotating drive shaft 21 in response to fluid flowing into housing 12. In the particular embodiment illustrated, drive means comprises a stator 25 which is secured within inlet 17 and a rotor 26 secured to the forward end 27 of drive shaft 21 for rotation therewith. It is to be understood that the rotor 26 may be secured to drive shaft 21 in any desired manner. In the particular embodiment illustrated the stator 25 comprises an outer ring retaining section 29 which mates with an annular ridge 30 formed in inlet stem 14, a plurality of vanes 39 connecting section 29 to a central cone 32. It is, however, to be understood that the stator 25 may be secured within inlet 17 by any desired means.

Drive shaft 21 at its rearward end 31 is rotatably mounted to gear train housing 15 by bearing 33. Rearward end 31 of drive shaft 21 provides the input to gear train 22, which includes an output shaft 48 and a second shaft 36, which is connected to drive shaft 21 by an appropriate number of gears 49 mounted within gear train housing 15. Gear train 22 is used to reduce the rotational speed of drive shaft 21. The appropriate selection and arrangement of gears 49 of gear train 22 are selected so as to provide the desired output rotational speed to output shaft 48. The accomplishing of such is of a routine nature to one of ordinary skill in the art. Secondary chamber 20 of gear train housing 15 is filled with an appropriate lubricant as is typically done in such prior art devices. However, the present invention is not so limited. If desired, gear train housing 15 may be of the flow through type wherein the fluid used to drive the drive shaft 21 passes through the chamber 20 to provide the appropriate cooling and lubricating desired.

The apparatus 10 further includes a Tee-housing 50 which is rotatably mounted to inlet stem 14 and gear train housing 15 by a pair of bearings 52 and adjacent seals 54 for rotation about the longitudinal axis X—X. The outward end 51 of output shaft 48 has a pinion gear 56 secured thereto for driving annular ring gear 58 which is secured to Tee-housing 50. Rotation of annular ring gear 58 causes Tee-housing 50 to rotate about inlet stem 14 and gear train housing 15. A drive bevel gear 66 is also secured to gear train housing 15 such that it is stationary therewith. The Tee-housing 50 comprises a generally cylindrical body section 65 which form an annular outer chamber 69 and an annular nose section 67 which extends outwardly from the body section 65 so as to form an inlet opening 68. In the particular embodiment illustrated the nose section 67 forms a substantially circular inlet opening 68 having a diameter D of about 1.5 inches (3.81 cm) and thus forms a predetermined cross-sectional area. Nose section 67 includes a plurality of outlet passageways 77, which in the particular embodiment are substantially rectangular.

The apparatus 10 further includes a nozzle carrier assembly 70 which is rotatably mounted to Tee-housing 50 which includes a body 71 having a receiving chamber 72 for receiving a liquid directly from nose section 67 of Tee-housing 50. At least one spray nozzle 76 is mounted to body 71 for rotation about axis Y—Y for spraying a liquid against the inside of the tank. In the particular embodiment illustrated, two spray nozzles 76 are provided. Outlet passageways 77 of the Tee-housing 50 connects chamber 72 to passageways 78 in spray nozzle 76. In the particular embodiment illustrated the axis Y—Y is substantially perpendicular to the axis X—X, however, the present invention is not so limited. Spray nozzles 76 are provided with male threads which engage internal threads 79 in body 71. Nozzle assembly 70 includes a driven bevel gear 82 which is designed to engage drive bevel gear 66 secured to gear train housing 15. Passageways 78 in nozzle carrier assembly 70 have smooth sidewalls 81 to minimize turbulence within nozzle assembly 70. Chamber 72 gradually reduces down in cross sectional areas as it proceeds to passageways 78. Preferably as illustrated the bottom 83 of outlet passageways 77 stops closely adjacent the bottom 84 of passageways 72. The nozzle assembly 70 is designed so as to minimize any fluid turbulence therein. As illustrated the sidewalls 81 of the body and sides 87 of chamber 72 are substantially smooth without any sharp points or curves. The Tee-housing is provided with a substantially conical shape projection 98 which is disposed directly above opening 68 of Tee-housing 50 so as to cause the fluid flow entering body 71 is divided substantially equally among the number of nozzles present. As can be seen, the projection 98 has a substantially V-shaped cone configuration within the point directly over the center of opening 68.

Figure 3:
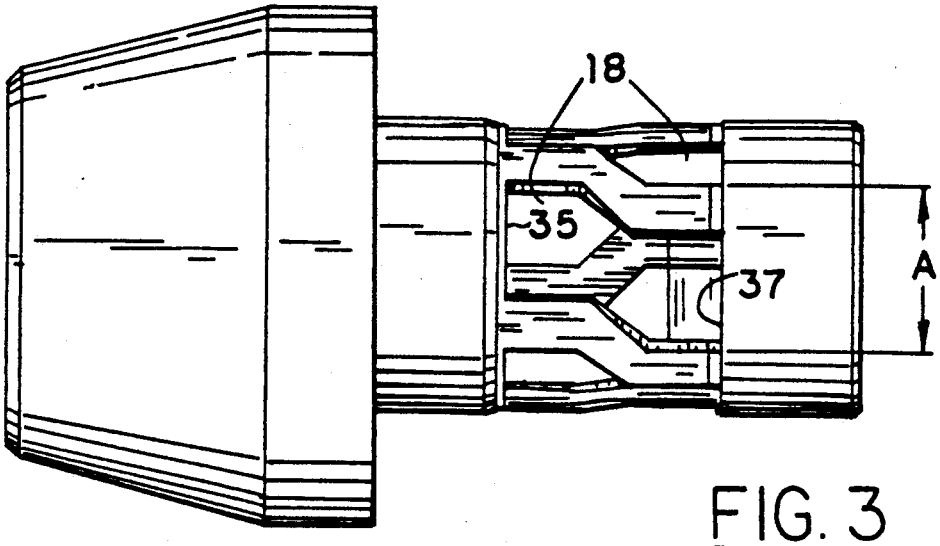
FIG. 3 is a side elevational view of the inlet stem illustrated in FIG. 2.

Referring to FIG. 3, there is illustrated a side elevational view of inlet stem 14. Inlet stem 14 is provided with a plurality of discharge openings 18 disposed about the circumference which forms a plurality of passageways with receiving chamber 19. The discharge openings 18 each have a configuration such that only a portion of each of the openings extend in the circumferentially direction so that adjacent openings 18 can provide a continuous opening in the circumferential direction. In the particular embodiment illustrated openings 18 each have a generally Z shaped configuration. The openings 18 each extend a predetermined distance A about the circumference of the inlet stem 14 and have a forward edge 35 and trailing end 37. The leading edge is preferably positioned to be closely adjacent the inner side 43 of nose section 67 and the trailing end 37 of discharge openings 18 are closely adjacent the rearward side 45 of nose section 67. The trailing edge 37 extends from boss 23 to outer surface inlet stem 14. The trailing edge 37 is preferably arcuate in shape to minimize fluid turbulence in chamber 19. The size, shape and positioning of discharge openings 18 are such that the cross-sectional area that is exposed to opening 68 as Tee-housing 50 is rotated about the inlet stem 14 is substantially constant.

Figure 4:
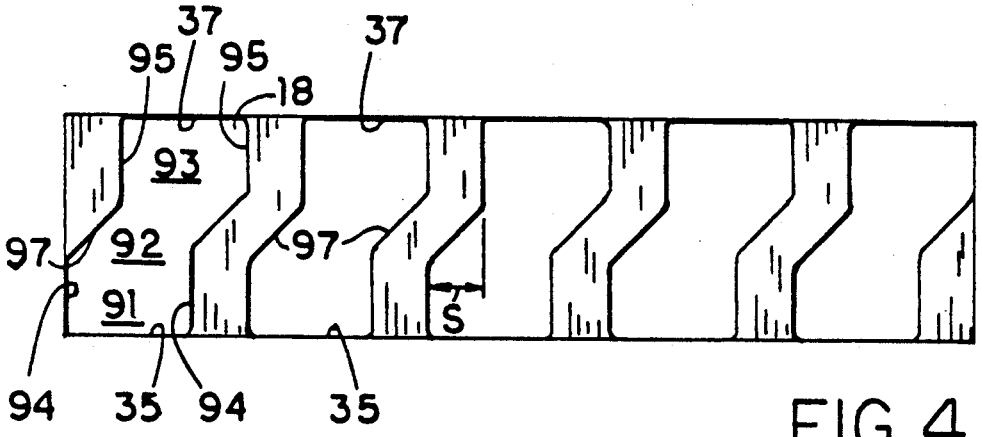
FIG. 4 is a layout view of the discharge openings of the inlet stem of FIG. 3.
Figure 5:
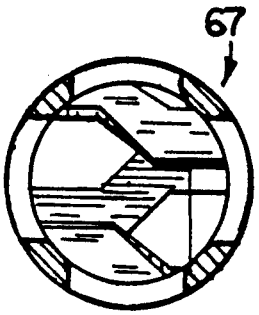
FIG. 5 is a top plan view of the discharge opening of the Tee-housing illustrated in the device of FIG. 2 taken along line 5—5.

Referring to FIG. 5, there is illustrated a top plan view of the opening 68, as taken along line 5—5 illustrating a pair of adjacent discharge openings 18 of inlet stem 14 as seen through opening 68. As illustrated, the total cross-sectional area of the discharge openings 18 adjacent opening 68 is not less than about 50% of the cross-sectional area of opening 68 of nose section 67 preferably not less than about 60%. In the particular embodiment illustrated, total cross-sectional areas of openings 18 with respect to opening 68 averages about 60%. As previously noted, in the particular embodiment illustrated, the discharge openings 18 each have a configuration substantially that of Z. Thus each discharge opening 18 has a forward section 91, a central circumferentially extending section 92 and rear section 93 as illustrated in FIG. 4 which illustrates a plan layout of the openings 18. Section 91 being defined by leading 35 and axial side edges 94 which are substantially parallel to axis X—X. Rear section 93 being defined by trailing edge 37 and axial edges 95 which are substantially parallel to axis X—X; section 93 being offset from section 91 in the circumferential direction a distance S. Section 92 connects section 91 and 93 and comprises a pair of substantially straight parallel sides 97. The amount of offset S in each groove is selected so that the edge 94 of section 91 lies in substantially the same axial plane as edge 95 of the circumferentially adjacent opening 18. As can be seen, the edge 94 of one discharge opening 18 starts about where the edge 95 of adjacent discharge opening 18 ends. However, it is to be understood that the particular configuration of discharge opening 18 may be varied as desired. The central circumferential extending section 92 provide a circumferential offset S which allows substantially constant cross section area of openings 18 to be exposed to opening 68 of Tee-housing 70. The important aspect is that there is substantially constant cross-sectional area of discharge openings 18 with respect to the nose section at all times as the Tee-housing 50 is rotated. The cross-sectional area of openings 18 should not vary more than about 25%, preferably not greater than about 15%, and most preferably not more than about 5%. In the particular embodiment illustrated, the cross-sectional area varies about 15%. Providing substantial constant area of opening 18 assists in minimizing or eliminating pulsating pressure. This problem becomes even more important with respect to more compact machines due to the limited space available.

As can be seen the apparatus 10 is designed so that the cleaning fluid flowing through the apparatus does not see any sharp edges or curves to minimize turbulence therein. Additionally the device has been designed to minimize pressure fluctuation within the device by minimizing any substantial change in the cross sectional area of the fluid flow passageways as the device is rotated through both axes. Further, the structure of the device has been designed to minimize the fluid pressure drop by eliminating any potential restriction areas within the fluid flow path. The device provides a substantially constant fluid flow from the rotor 26 to the area clearly adjacent nozzle 76.

In order to more fully understand the present invention, a brief description of the operation of the apparatus will be discussed. A fluid under pressure is provided at inlet 17 and passes through stator 25 and rotor 26. This fluid flow causes rotor 26 to rotate, thus causing primary shaft 21 also to rotate about its longitudinal axis X—X. This causes the drive gear train 22 and output shaft 48 to rotate. Output shaft 48, in turn drives pinion gear 56 which causes annular ring gear 58 to rotate which results in Tee-housing 50 to rotate about longitudinal axis X—X. While Tee-housing 50 is rotating along axis X—X, drive bevel gear 66 engages bevel gear 82 through an opening in Tee-housing which causes the nozzle carrier assembly 70 to rotate about axis Y—Y.

It is to be understood that various changes and modifications may be made without departing from the scope of the present invention. For example, but not by way of limitation, there may be any desired number of nozzles used as desired, the configuration and shape of the discharge openings of inlet 70 may be varied as desired. The present invention being limited by the following claims.

What is claimed is:

1. A fluid driven tank cleaning apparatus comprising:

an inlet stem having a fluid receiving chamber, an inlet for connecting said fluid receiving chamber to a source of fluid under pressure and a substantially cylindrical rear section having a plurality of discharge openings about its circumference;

a gear train housing secured to said inlet stem, said gear train housing having a secondary chamber separated from said fluid receiving chamber by a common wall;

a drive shaft rotatably mounted to said apparatus such that at least a portion of said device shaft is within said receiving chamber;

drive means connected to said drive shaft and disposed within said inlet for rotating said drive shaft in response to a fluid entering said inlet stem;

gear reduction means disposed within said secondary chamber and being connected to said drive shaft for reducing the rotation speed of said drive shaft;

a Tee-housing rotatably mounted to said inlet stem and/or gear training housing so as to rotate about a first axis, said Tee-housing having a generally cylindrical body section about said inlet stem and a nose section which extends for only a portion of the circumference of said rear cylindrical rear section of said inlet stem, said nose section rotates about the circumference of said inlet stem adjacent said discharge openings and has an inlet opening for receiving a fluid exiting from said discharge openings in said rear section of said inlet stem;

an output shaft rotatably mounted in said secondary chamber, and said output shaft being connected to said drive shaft through said gear reduction means;

a fluid nozzle assembly mounted to said Tee-housing for rotation about a second axis, said fluid nozzle assembly being fluidly connected to said fluid receiving chamber through said plurality of discharge openings in said inlet stem;

means for connecting said output shaft to said nozzle assembly so as to cause said nozzle assembly to rotate about said secondary axis in a predetermined manner;

said discharge openings in said inlet stem having a forward edge and a rear trailing edge with the forward edge of a discharge opening substantially coextending or slightly overlapping the rear edge of a next adjacent discharge opening such that said discharge openings have a size and configuration such that a substantially constant cross-sectional area of discharge opening is directly opposed to and communicates directly with said inlet opening of said nose section of said Tee-housing as said Tee-housing is rotated about said inlet stem.

2. A fluid driven tank cleaning apparatus according to claim 1, said trailing edge of each of said discharge openings of said stems having a substantially smooth continuous configuration.

3. A fluid driven tank cleaning apparatus according to claim 2 wherein said trailing edge has a smooth curved surface so as to provide a smooth transition into said inlet opening of said nose section.

4. A fluid driven tank cleaning apparatus according to claim 1 wherein the inlet nose section opening of said Tee-housing has a cross-sectional substantially equal to the cross-sectional area of said discharge opening which is directly adjacent to said discharge opening as it rotates about said inlet stem.

5. A fluid driven tank cleaning apparatus comprising:

an inlet stem having a fluid receiving chamber, an inlet for connection said fluid receiving chamber to a source of fluid under pressure and a substantially cylindrical rear section having a plurality of discharge openings about its circumference;

a gear train housing secured to said inlet stem;

a drive shaft rotatably mounted to said apparatus such that at least a portion of said drive shaft is within said receiving chamber;

drive means connected to said drive shaft and disposed within said inlet for rotating said drive shaft in response to a fluid entering said inlet stem;

gear reduction means disposed within said gear train housing and being connected to said rive shaft for reducing the rotation speed of said drive shaft;

a Tee-housing rotatably mounted to said inlet stem and/or gear train housing so as to rotate about a first axis, said Tee-housing having an nose section which extends for only a portion of the circumference of said cylindrical rear section of said inlet stem, said nose section rotates about the circumference of said inlet stem adjacent said discharge opening and has an inlet opening for receiving fluid exiting from said discharge openings in said inlet stem;

an output shaft rotatably mounted in said gear train housing and being connected to said drive shaft through said gear reduction means;

a fluid nozzle assembly mounted to said Tee-housing for rotation about a second axis, said fluid nozzle assembly being fluidly connected to said fluid receiving chamber through said plurality of discharge openings in said inlet stem;

means for connecting said output shaft to said nozzle assembly so as to cause said nozzle assembly to rotate about said secondary axis in a predetermined manner;

said discharge openings in said inlet stem having a forward edge and a rear trailing edge, with the forward edge of a discharge opening substantially coextending or slightly overlapping the rear edge of a next adjacent discharge opening such that said discharge openings have a size and configuration such that a substantially constant cross-sectional area of discharge opening is directly opposed to and communicates with said inlet opening of said nose section of said Tee-housing as said Tee-housing is rotated about said inlet stem.

* * * * *